US005661935A

United States Patent [19]

Erickson et al.

[11] Patent Number: 5,661,935

[45] Date of Patent: Sep. 2, 1997

[54] STORM PANEL TRACK

[76] Inventors: Glen Erickson; Linda Erickson, both of 8736 NW. 40th St., Coral Springs, Fla. 33065

[21] Appl. No.: 657,688

[22] Filed: May 31, 1996

Related U.S. Application Data

[60] Provisional application No. 60/010,197, Jan. 18, 1996.

[51] Int. Cl. [6] ..... E06B 3/26

[52] U.S. Cl. ..... 52/202; 52/204.1; 49/62

[58] Field of Search ..... 52/202, 204.1; 49/62, 63, 65, 66, 61

[56] References Cited

U.S. PATENT DOCUMENTS

| | | | |
|---|---|---|---|
| 4,044,813 | 8/1977 | Emmons | 52/202 X |
| 4,399,640 | 8/1983 | Porter | 52/202 |
| 4,452,020 | 6/1984 | Werner | 52/202 |
| 4,733,510 | 3/1988 | Werner | 49/62 X |
| 4,754,585 | 7/1988 | Rundo | 52/202 |
| 4,905,569 | 3/1990 | Seksaria et al. | 52/202 X |
| 5,086,604 | 2/1992 | Orth | 52/202 X |
| 5,253,457 | 10/1993 | Orth | 52/202 |

*Primary Examiner*—Carl D. Friedman
*Assistant Examiner*—Yvonne Horton-Richardson
*Attorney, Agent, or Firm*—Robert M. Downey, P.A.

[57] ABSTRACT

A track assembly for mounting storm panels on the outside of a house or a building to protectively cover windows includes an elongate, extruded rail having a rear surface, a front face, top and bottom edges, an elongate channel formed through the length of the rail between the rear surface and front face, and an elongate exposed slot extending along the front face and communicating with the channel. The channel is structured to receive an enlarged head portion of a bolt with the bolt stud extending outwardly through the slot for receipt through an aperture in the storm panel. A wing nut is fastened to the bolt stud to secure the storm panel against the track assembly.

15 Claims, 2 Drawing Sheets

STORM PANEL TRACK

This application claims the benefit of U.S. Provisional Application No. 60/010,197, filed Jan. 18, 1996.

BACKGROUND OF THE INVENTION

1. Field of the Invention

The present invention relates to mounting structures for mounting storm panels on a house or building and, more specifically, to a track structure for supporting bolts or studs used to fasten storm panels to the outside of a building or house in covering relation to windows.

2. Description of the Related Art

Storm panels are commonly used to protect windows and sliding glass doors from damage which may result from high winds and flying debris normally experienced during a tropical storm or hurricane. Presently, storm panels are mounted to the exterior of a building or a house using bolts or threaded studs. In some instances, holes are drilled at spaced intervals above and below a window or door to be protected and threaded sockets are anchored in the holes. To mount the storm panels to the building, apertures in the panels are aligned with the threaded holes in the building and bolts are used to secure the panels to the building. In other instances, an L-shaped bracket is secured to the wall below the window or door structure. A plurality of threaded studs, fixed to the bracket at spaced intervals, extend outwardly for receipt through the apertures in the storm panels. A C-shaped track is normally provided above the window or door to receive the upper edge of the panels. To secure the panels to the building, wing nuts are fastened on the threaded studs and tightened down against the panel surface. In either of the above examples of the more common type of storm panel mounting systems used in the related art, there is an undesirable appearance which results once the panels are removed. In the first instance, the exterior wall above and below the windows or doors are left with a series of holes which are clearly visible and unattractive. Further, a problem arises if the holes in the wall are not drilled at the proper spaced intervals to align with the corresponding apertures in the storm panels. In the other instance, the L-shaped bracket is clearly visible and detracts from the appearance of a house or building. The L-shaped bracket can be removed, leaving two or more holes which are visible. However, this is generally not done by most homeowners because it requires a great deal of extra labor, especially in the haste just prior to an approaching storm.

Accordingly, there is an urgent need in the storm panel art for a track structure which is aesthetically pleasing in appearance and, generally not normally visible when not in use, and which further facilitates quick and efficient installation of storm panels to cover windows, sliding glass doors, and other structures which need to be protected from wind damage.

BRIEF DESCRIPTION OF THE DRAWINGS

For a fuller understanding of the nature of the present invention, reference should be had to the following description taken in connection with the accompanying drawings in which.

Like reference numerals refer to like parts throughout the several views of the drawings.

DETAILED DESCRIPTION OF THE PREFERRED EMBODIMENTS

Figure 1:
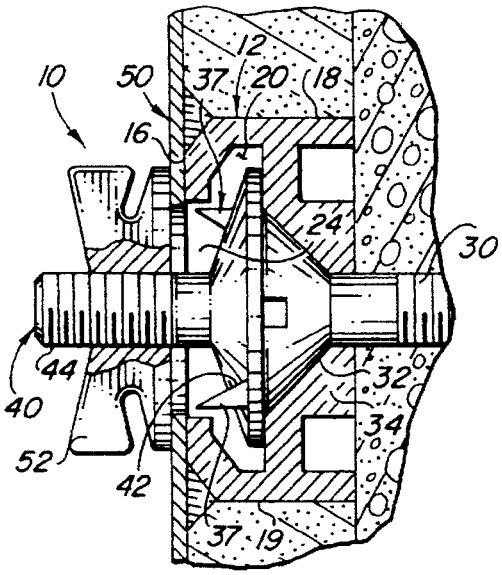
FIGS. 1 and 1A are sectional views of a first embodiment of the storm panel track assembly, wherein the track is recessed with the exterior wall of a house or building.

Referring to the several views of the drawings, each of the embodiments of the present invention are directed to a track structure 10 for mounting storm panels on the outside of a house or building to cover windows, sliding glass doors, and like closure structures so as to protect these structures from damage which may otherwise result when exposed to high winds and flying debris.

The track structure 10 includes an elongate track or rail 12 having a rear surface 14, a front face 16, and top and bottom edges 18, 19. The track 12 further includes an elongate channel 20 formed along a length of the track between the rear surface 14 and front face 16. An elongate slot 24 extends along the front face 16, exposing the channel 20 and permitting access thereto.

In the embodiments of FIGS. 1–4, the track 12 is installed as a recess mount within the exterior wall of a house or a building. In the instance of CBS-type construction, this can be accomplished by fastening the rear surface 14 against the concrete using a concrete or tapcon screw 30 which passes through a series of countersunk apertures 32 formed at spaced intervals along the rear wall 34 of the track 12. The outer stucco layer is then applied so that the track structure is embedded or recessed in the outer wall, exposing only the front face 16 and slot 24.

In the embodiment of FIG. 1, a plurality of elevator bolts 40 are fitted within the track 12 by sliding the enlarged head portion 42 of the bolts 40 through opposite ends of the track 12, or other access openings provided along a length of the track 12. With the threaded stud 44 of the bolt 40 extending out through the slot 24, the bolts 40 can be slid along the length of the channel 20 until the threaded stud 44 is properly aligned with the aperture formed in each of the respective storm panels 50. With the threaded stud 44 extending through the respective aperture of a storm panel 50, a wing nut 52 is threadably advanced and tightened down on the stud 44 until tight against the exterior surface of the storm panel 50, thus securing the panel to the building.

Figure 2:
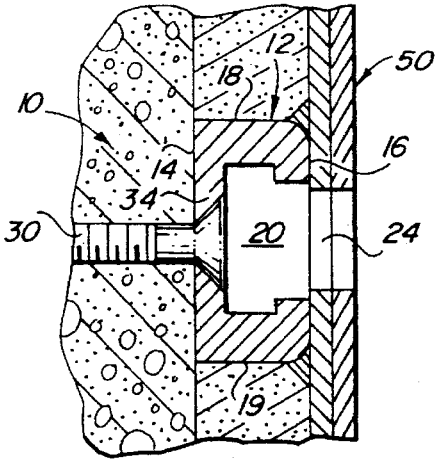
FIG. 2 is a sectional view of a second embodiment of the track assembly recessed within the exterior wall of a house or a building.
Figure 3:
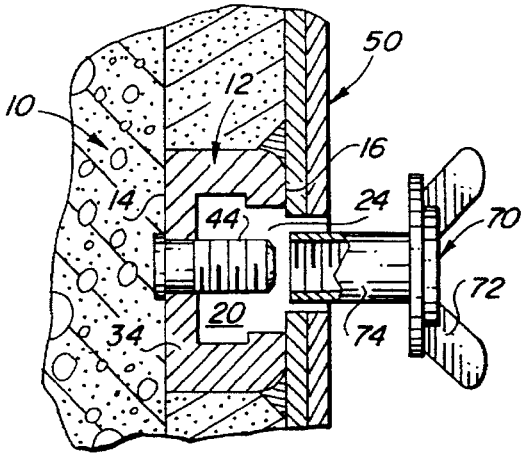
FIG. 3 is a sectional view of the embodiment of FIG. 2 showing a machine bolt stud and winged head fastening element used to secure storm panels to the exterior of the building.
Figure 4:
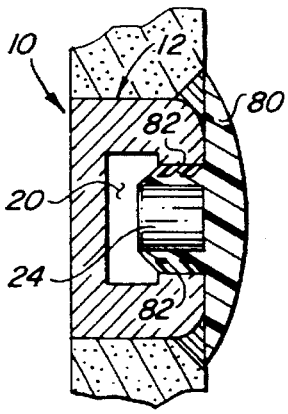
FIG. 4 is a sectional view of the embodiment of FIG. 2 showing a vinyl cover which fits within an elongate slot of the track to conceal the slot from normal view when storm panels are removed.
Figure 5:
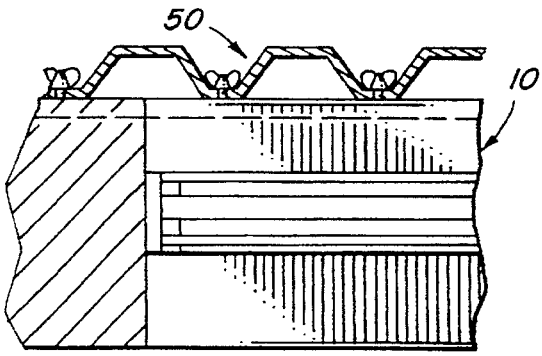
FIG. 5 is a top plan view showing attachment of storm panels to the track assembly of the present invention.

In the embodiment of FIGS. 2 and 3, a plurality of threaded machine bolt studs are fixedly secured to the rear wall 34 of the track so that they extend through the channel 20 towards the slot 24 at spaced intervals along the length of the track 12. A sex bolt 70 with a wing 72 or phillips head and a threaded bore tube 74 is fitted on each of the threaded bolt studs 44' to secure the panel on the building.

In either of these embodiments, as well as the following embodiments, a vinyl or plastic cover 80 can be snap-fit within the slot 24 to cover the slot 24 when the panels are removed, thus hiding the slot and track structure from normal view. The cover 80 may be provided with grasping means 82 to catch on the interior surfaces of the slot 24 or channel 20.

Figure 6:
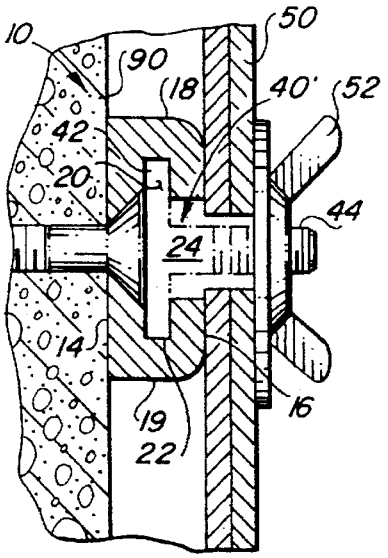
FIG. 6 is a sectional view illustrating yet another embodiment of the present invention wherein the track is mounted to an exterior surface of the building.
Figure 8:
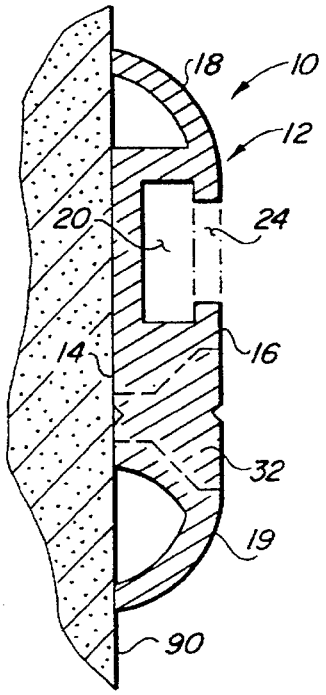
FIG. 8 is a sectional view of another embodiment of the invention wherein the track mounts to the exterior surface of a building using screws that fit within countersunk apertures formed at spaced intervals below the channel of the track.
Figure 7:
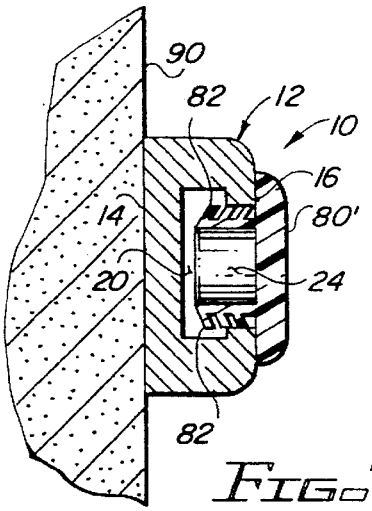
FIG. 7 is a sectional view of the embodiment of FIG. 6 showing a vinyl cover fitted in covering relation to the elongate slot in the same manner as that shown in FIG. 4.

Referring to FIGS. 6–8, further embodiments of the track structure 10 are shown wherein the track 12 is mounted to an exterior surface 90 of a building. In these embodiments, the rear surface 14 of the track 12 is placed against the exterior surface 90 of the building and tapcon screws or concrete screws 30 are fitted through countersunk apertures 32 formed in the rear wall 34 to secure the track 12 to the exterior surface 90. In the embodiment of FIG. 6, a plurality of square head machine bolts 40' are fitted so that the square head 42' is received within the channel 20 and the threaded stud 44 extends out through the slot 24. Much like the embodiment of FIG. 1, the square head machine bolts 40' can be slid along the length of the channel 20 until the threaded stud 44' is aligned with the corresponding aperture of each of the respective storm panels 50. Again, much like the embodiment of FIG. 1, a wing nut 52 is threadably advanced on the stud 44' and tightened down until mating with the exterior surface of the panel 50, to secure the panel 50 to the building.

In the embodiment of FIG. 8, the track 12 includes the channel 20 and slot 24 on an upper portion and the countersunk bore 32 on a lower portion, thus facilitating ease of attachment of the track 12 to the exterior surface 90 of the building. The top 18 and bottom 19 edges are rounded to blend with the front face 16, thus providing a smooth appearance which is attractive and not highly visible on the exterior of the building. Much like the embodiment of FIG. 4, a vinyl or plastic cover 80' can be used to cover the slot opening 24 of the embodiments of FIG. 6 and FIG. 8.

Figure 9:
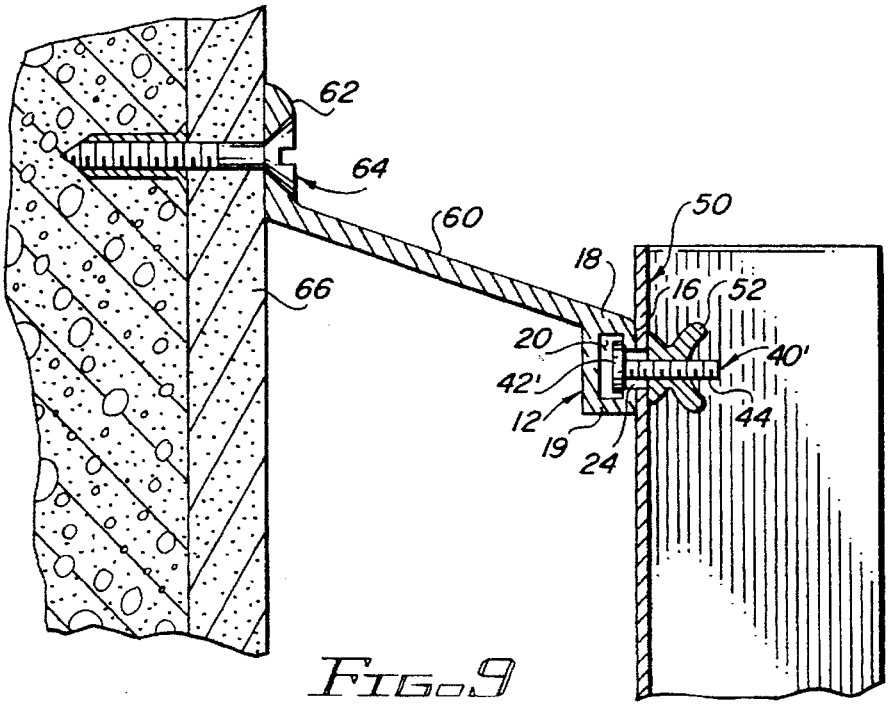
FIG. 9 is a sectional view illustrating yet another embodiment of the invention wherein the track assembly includes a mounting flange and an extension plate extending between the mounting flange and the track structure so that storm panels mounted to the track assembly are maintained at a predetermined spaced distance from glass window or door closures.

Referring to FIG. 9, there is illustrated yet another embodiment of the track structure 10. As seen in FIG. 9, an extension plate 60 extends between a mounting flange 62 and the track housing 12. The mounting flange 62 includes a rear surface 66 which is adapted to mate with the exterior surface 90 of the building above and/or below a window or door closure structure. The flange 62 is secured to the wall using screws 64 which fit through apertures at spaced intervals along the length of the flange 62. The flange 62, extension plate 60, and track housing 12 are extruded as one piece so that the extension plate 60 and flange 62 extend along the entire length of the track 12. The extension plate 60 maintains the track housing 12 at a predetermined spaced distance from the exterior surface 90 of the building, as well as the glass window or door closure structure, so that the storm panels 50, when mounted to the track structure 10, are maintained at a predetermined distance from the glass windows or doors, as may be required by building codes in certain municipalities.

The extension plate 60 extends outwardly and slightly downward from the exterior surface 90 of the building structure, so that when placed above a window or door, it provides a protective overhang. Thus, when the storm panels 50 are removed, the extension plate 60 serves as an awning to partially shield windows and doors from rain, sleet, hail, and the like.

Figure 1A:
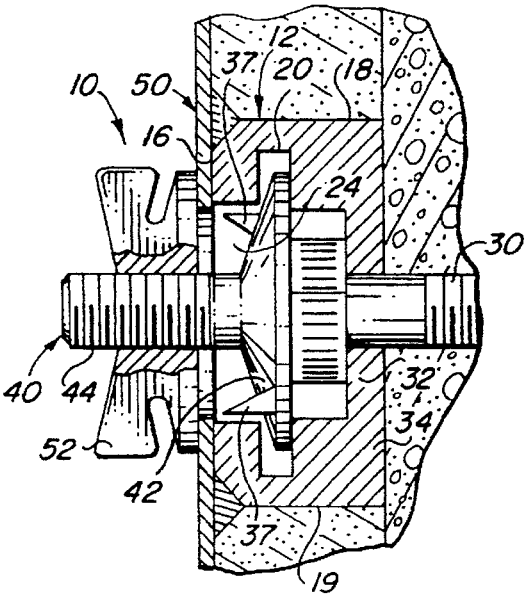

In each of the above-described embodiments, the bolts 40 and 40' are provided with heads 42, 42' which are specifically structured and configured to prevent rotation of the stud 44 once the heads 42, 42' are received within the channel 20. This can be achieved by providing the bolts 40' with a multi-sided head 42' which will engage upper and lower surfaces 21, 22 of the channel 20 upon applying a rotation force to the bolt stud 44. Alternatively, the bolts can be fitted within the rear wall 34 of the track structure 12 at spaced intervals so that the threaded stud 44 remains fixed, as seen in FIG. 3. In still another embodiment, the head 42 can be made to lockingly engage protruding fangs 37 on the bolt 40, to prevent rotation of the bolts 40 when the fangs engage the edges of slot 24, as seen in FIGS. 1 and 1A.

While the instant invention has been described and illustrated in what is considered to be practical and preferred embodiments thereof, it is recognized that departures may be made in both structure and configuration which should not be limited except within the spirit and scope of the invention.

Now that the invention has been described,

What is claimed is:

1. An assembly for mounting storm panels on a house or building having a wall structure with an exterior surface surrounding glass window and door structures, wherein said storm panels include a plurality of apertures formed therethrough at spaced intervals along a periphery thereof, said assembly comprising:

an elongate rail having a rear wall with a rear surface, a front wall with a front face, top and bottom edges, an elongate channel extending substantially along a length of said rail between said rear wall and said front wall, and an elongate slot opening formed through said front face and said front wall and extending substantially along a length of said rail and communicating with said channel through said front wall, a plurality of bolts each having an enlarged head portion and a stud, said plurality of bolts being maintained within said channel so that said bolts are positioned at spaced intervals therealong with said studs of said bolts extending outwardly towards said slot opening, means for mounting said rail to said wall structure of said house or building adjacent to said window and door closures, and a plurality of fastening elements removably attachable to said studs to secure said storm panels to said rail so that said storm panels are supported in spaced, covering relation to said window and door closures.

2. An assembly as recited in claim 1 further including removable cap means for covering and concealing said slot opening when said storm panels are removed from said rail.

3. An assembly as recited in claim 1 wherein said head portion of each of said bolts is multi-sided and sized and configured for sliding receipt along a length of said channel, said multi-sided head portion being structured to engage upper and lower surfaces of said channel upon application of a rotational force to said bolts, thereby preventing said studs from rotating when attaching said respective fastening elements thereto.

4. An assembly as recited in claim 1 wherein said plurality of bolts are fitted through said rear wall of said rail and maintained in fixed, non-rotating position along the length of said channel.

5. An assembly as recited in claim 1 wherein said head portion of each of said bolts includes means thereon for engaging said mounting means to prevent said bolts from rotating when attaching said respective fastening elements to said studs of said bolts.

6. An assembly as recited in claim 1 wherein said studs include thread means thereon for threaded engagement with said fastening elements.

7. An assembly for mounting storm panels on a house or building having a wall structure with an exterior surface surrounding window and door closures, wherein said storm panels include a plurality of apertures formed therethrough at spaced intervals along a periphery thereof, said assembly comprising:

an elongate rail having a rear wall with a rear surface, a front wall with a front face, top and bottom edges, an elongate channel extending substantially along a length of said rail between said rear wall and said front wall and an elongate slot opening formed through said front face and said front wall and extending substantially along a length of said rail and communicating with said channel, a plurality of bolts each, having an enlarged head portion and a stud extending from said head portion, said head portion being sized and configured for sliding, non-rotating receipt within said channel so that said bolts are positioned at spaced intervals along said rail with said stud of each of said bolts extending outwardly through said slot opening on said front face for receipt through apertures in said storm panels, exposing said studs exteriorly of said rail and said storm panels, means for mounting said rail to said wall structure of said house or building adjacent to said window and door closures, and a plurality of fastening elements removably attachable to said studs to secure said storm panels to said rail, so that said storm panels are supported in spaced, covering relation to said window and door closures.

8. An assembly as recited in claim 7 further including removable cap means for covering and concealing said slot opening when said storm panels are removed from said rail.

9. An assembly as recited in claim 7 wherein said head portion of each of said bolts is multi-sided and sized and configured to engage upper and lower surfaces of said channel upon application of a rotational force to said bolts, thereby preventing said studs from rotating when attaching said respective fastening elements thereto.

10. An assembly as recited in claim 7 wherein said bolts include means for engaging said mounting means to prevent said bolts from rotating when attaching said respective fastening elements to said studs of said bolts.

11. An assembly as recited in claim 7 wherein said distal end zones of said studs include thread means thereon for threaded engagement with said fastening elements.

12. An assembly as recited in claim 7 further including a mounting flange and an extension plate extending between said mounting flange and said rail, said mounting flange including said mounting means for mounting said flange to said wall structure.

13. An assembly as recited in claim 12 wherein said extension plate extends away from said mounting flange so as to maintain said rail at a predetermine distance from said wall structure of said house or building.

14. An assembly as recited in claim 13 wherein said extension plate is structured and disposed to maintain said rail at said predetermined distance from said wall structure so that said storm panels, when mounted to said rail, are maintained at a predetermined spaced distance from said window and door closures.

15. An assembly as recited in claim 14 wherein said extension plate defines a protective overhang to partially shield said window and door closures from rain, sleet, hail, and sunlight.

* * * * *